US006895684B1

(12) United States Patent
Firth

(10) Patent No.: US 6,895,684 B1
(45) Date of Patent: May 24, 2005

(54) STUD POSITIONING TOOL

(76) Inventor: Leroy N. Firth, 253 Westbrook St., South Thomaston, ME (US) 04858

( * ) Notice: Subject to any disclaimer, the term of this patent is extended or adjusted under 35 U.S.C. 154(b) by 17 days.

(21) Appl. No.: 10/783,431

(22) Filed: Feb. 23, 2004

(51) Int. Cl.[7] ..... G01B 5/14
(52) U.S. Cl. ..... 33/613; 33/562
(58) Field of Search ..... 33/613, 562, 526, 33/194, 494, 679.1, 645; 269/43, 910; D10/64

(56) References Cited

U.S. PATENT DOCUMENTS

| | | | | | |
|---|---|---|---|---|---|
| 1,665,400 | A | | 4/1928 | Bittner | |
| 2,187,087 | A | * | 1/1940 | Leary | 33/758 |
| 2,686,959 | A | * | 8/1954 | Robinson | 33/613 |
| 3,169,320 | A | | 2/1965 | Carrie | |
| 3,201,874 | A | | 8/1965 | Christy | |
| 4,212,108 | A | | 7/1980 | Jackson | |
| 4,322,064 | A | * | 3/1982 | Jarvis | 269/43 |
| 4,499,666 | A | * | 2/1985 | Smith | 33/562 |
| 4,527,337 | A | | 7/1985 | Dreiling | |
| 4,625,415 | A | * | 12/1986 | Diamontis | 33/613 |
| D314,520 | S | | 2/1991 | Hass | |
| 5,129,153 | A | * | 7/1992 | Burns, Sr. | 33/613 |
| 5,163,233 | A | * | 11/1992 | Benson | 33/613 |
| 5,367,783 | A | | 11/1994 | Nygren | |
| 5,491,905 | A | * | 2/1996 | Jablonski et al. | 33/613 |
| 5,509,207 | A | | 4/1996 | Harms | |
| 5,628,119 | A | | 5/1997 | Bingham et al. | |
| 5,768,795 | A | * | 6/1998 | Jimenez | 33/613 |
| 5,884,411 | A | * | 3/1999 | Raber | 33/613 |
| 5,937,531 | A | | 8/1999 | Menk et al. | |
| 6,070,336 | A | * | 6/2000 | Rodgers | 33/613 |
| 6,293,028 | B1 | * | 9/2001 | Sylvia | 33/613 |
| 6,775,916 | B2 | * | 8/2004 | Sparkes | 33/613 |

* cited by examiner

*Primary Examiner*—R. Alexander Smith

(57) ABSTRACT

A stud positioning tool includes an elongated bar that has a first end, a second end, a front side, a back side, a top side and a bottom side. A plurality of legs is attached to and extends downwardly from the bottom side. Each of the legs is spaced from each other. The legs each include a positioning plate. Each of the positioning plates has opposite surfaces lying in planes orientated perpendicular to a longitudinal axis of the bar. A plurality of positioning indicia is positioned on the front side. Each of the positioning indicia has an edge aligned with one of the positioning plates. Each of the indicia of the positioning indicia is spaced 16 inches from each other. Studs are each positioned against one of the positioning plates and aligned with one of the positioning indicia such that the studs are positioned 16 inches from each other.

11 Claims, 2 Drawing Sheets

STUD POSITIONING TOOL

BACKGROUND OF THE INVENTION

1. Field of the Invention

The present invention relates to stud positioning devices and more particularly pertains to a new stud positioning device for providing the positioning of wall studs when framing a wall.

2. Description of the Prior Art

The use of stud positioning devices is known in the prior art. U.S. Pat. No. 5,608,199 describes a device which is elongated and includes a pair of slots therein each adapted for receiving a stud. The slots are spaced a distance required to ensure proper placement of the studs. Another type of stud positioning device is U.S. Pat. No. 5,937,531 having adjustable brackets thereon which can be spaced a selected distance from each other. Once the distance has been selected, this device can be used to position a plurality of studs, one at a time, the selected distance apart from each other. Yet another such device is U.S. Pat. No. 3,201,874 which again utilizes slots for receiving studs to place them a selected distance from each other.

While these devices fulfill their respective, particular objectives and requirements, the need remains for a device that allows a plurality of studs to be simultaneously aligned. The device also supports itself in a vertical position while the wall frame is position on a ground surface during its construction.

SUMMARY OF THE INVENTION

The present invention meets the needs presented above by the present invention generally comprises an elongated bar that has a first end, a second end, a front side, a back side, a top side and a bottom side. A plurality of legs is attached to and extends downwardly from the bottom side. Each of the legs is spaced from each other. The legs each include a positioning plate. Each of the positioning plates has opposite surfaces lying in planes orientated perpendicular to a longitudinal axis of the bar. A plurality of positioning indicia is positioned on the front side. Each of the positioning indicia has an edge aligned with one of the positioning plates. Each of the indicia of the positioning indicia is spaced 16 inches from each other. Studs are each positioned against one of the positioning plates and aligned with one of the positioning indicia such that the studs are positioned 16 inches from each other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
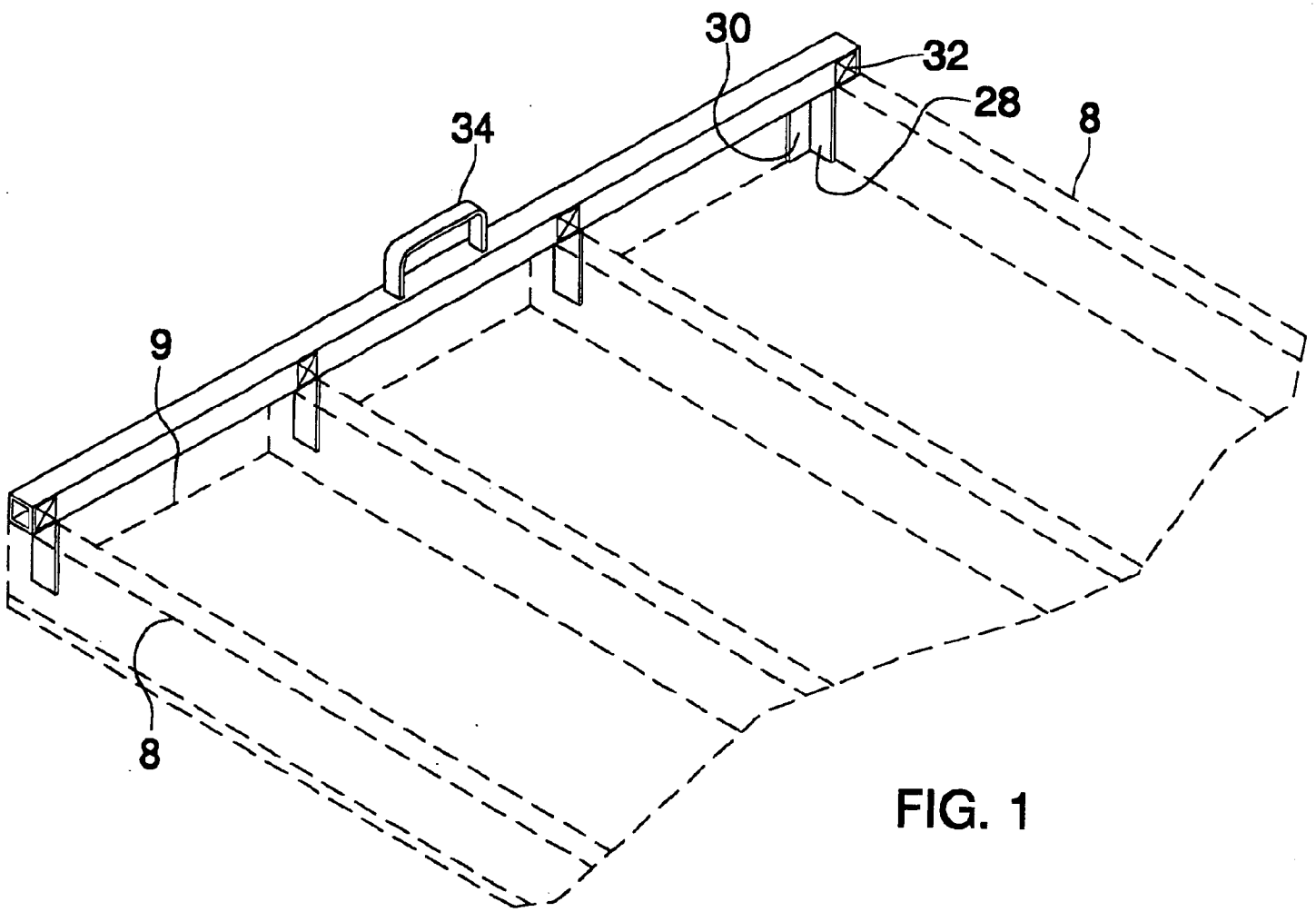
FIG. 1 is a perspective in-use view of a stud positioning tool according to the present invention.
Figure 2:
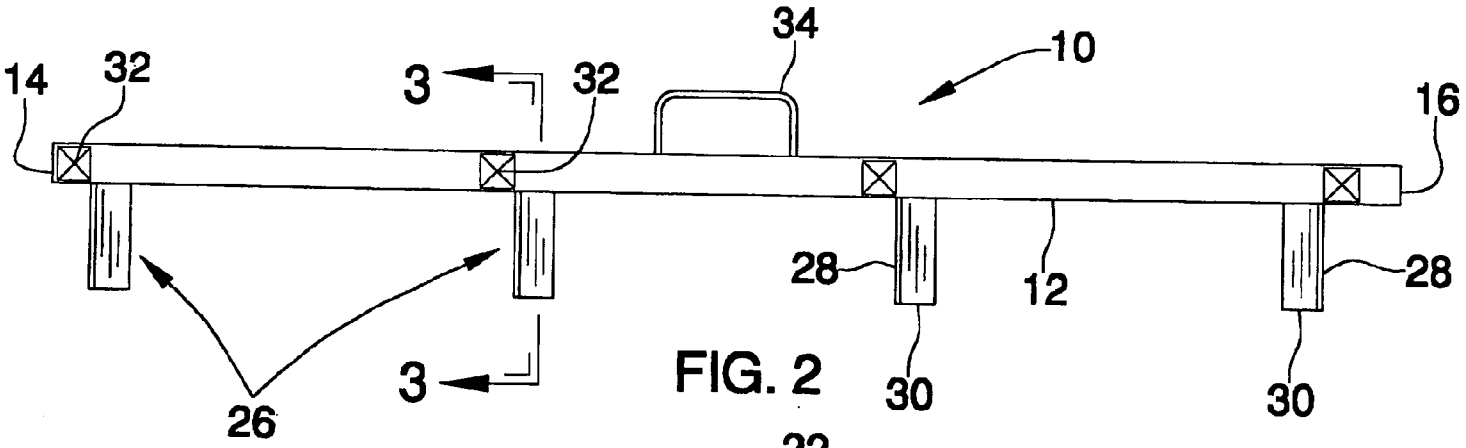
FIG. 2 is a front view of the present invention.
Figure 3:
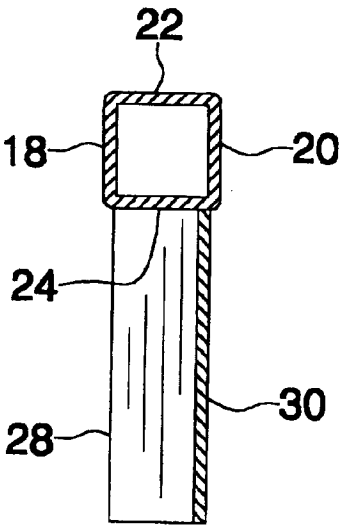
FIG. 3 is a cross-sectional view taken along line 3—3 of FIG. 2 of the present invention.

With reference now to the drawings, and in particular to FIGS. 1 through 3 thereof, a new stud positioning device embodying the principles and concepts of the present invention and generally designated by the reference numeral 10 will be described.

As best illustrated in FIGS. 1 through 3, the stud positioning tool 10 generally comprises an elongated bar 12 that has a first end 14, a second end 16, a front side 18, a back side 20, a top side 22 and a bottom side 24. The bar 12 has a length is at least equal to 48 inches.

A plurality of legs 26 is attached to and extends downwardly from the bottom side 24. Each of the legs 26 is spaced from each other and each preferably includes a positioning plate 28 and a support plate 30. The positioning 28 and support 30 plates are attached along an edge such that the positioning 28 and support 30 plates form a generally perpendicular angle. Each of the positioning plates 28 has opposite surfaces lying in planes orientated perpendicular to a longitudinal axis of the bar 12 and each of the support plates 30 has opposite surfaces lying in planes orientated generally parallel to the longitudinal axis. It is preferred that each of the support plates 30 is positioned generally adjacent to the back side 20. The plurality of legs 26 preferably includes four legs.

A plurality of positioning indicia 32 is positioned on the front side 18. Each of the positioning indicia 32 has an edge aligned with one of the positioning plates 28. Though different measurements may be used for different types of jobs to be accomplished, for positioning wall studs, it is preferred that each of the indicia 32 of the positioning indicia is spaced 16 inches from each other. It is also preferred that when viewing the tool 10 face on, the positioning plates 28 are positioned between the adjacent positioning indicia 30 and an attached one of the support plates 30.

A handle 34 is attached to the top side 22 of the bar 12. The handle 34 is generally centrally positioned with respect to the first 14 and second 16 ends. The handle 34 is preferably of an inverted U-shape which allows for better control over the bar 12 when moving and positioning the tool 10.

In use, the studs 8 may be positioned against one of the positioning plates 30 and aligned with one of the positioning indicia 32 such that the studs 8 are positioned 16 inches from each other. The support plates 30 aid in the vertical supporting of the tool and also allow the user to better align the studs with the bottom portion 9 of a wall frame.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stud positioning device for determining the relative positioning of a plurality of wall studs, said device comprising:

an elongated bar having a first end, a second end, a front side, a back side, a top side and a bottom side;

a plurality of legs being attached to and extending downwardly from said bottom side, each of said legs being spaced from each other, each of said legs including a positioning plate, each of said positioning plates having opposite surfaces lying in planes orientated perpendicular to a longitudinal axis of said bar;

a plurality of positioning indicia being positioned on said front side, each of said positioning indicia having an edge aligned with one of said positioning plates, each of said indicia consisting of said positioning indicia being spaced 16 inches from each other; and wherein each of the studs is capable of being positioned against one of the positioning plates and aligned with one of said positioning indicia such that the studs are positioned 16 inches from each other.

2. The device according to claim 1, wherein said bar has a length being at least equal to 48 inches.

3. The device according to claim 1, wherein each of said legs includes a support plate, said positioning and support plates being attached along an edge such that said positioning and support plates form a generally perpendicular angle.

4. The device according to claim 3, wherein each of said support plates has opposite surfaces lying in planes orientated generally parallel to said longitudinal axis.

5. The device according to claim 4, wherein each of said support plates is positioned generally adjacent to said back side.

6. The device according to claim 3, further including a handle being attached to said top side of said bar.

7. The device according to claim 6, wherein said handle is generally centrally positioned with respect to said first and second ends.

8. The device according to claim 1, wherein said plurality of legs includes four legs.

9. The device according to claim 1, further including a handle being attached to said top side of said bar.

10. The device according to claim 9, wherein said handle is generally centrally positioned with respect to said first and second ends.

11. A stud positioning device for determining the relative positioning of a plurality of wall studs, said device comprising:

an elongated bar having a first end, a second end, a front side, a back side, a top side and a bottom side, said bar having a length being at least equal to 48 inches;

a plurality of legs being attached to and extending downwardly from said bottom side, each of said legs being spaced from each other, each of said legs including a positioning plate and a support plate, said positioning and support plates being attached along an edge such that said positioning and support plates form a generally perpendicular angle, each of said positioning plates having opposite surfaces lying in planes orientated perpendicular to a longitudinal axis of said bar, each of said support plates having opposite surfaces lying in planes orientated generally parallel to said longitudinal axis, each of said support plates being positioned generally adjacent to said back side, said plurality of legs being four legs;

a plurality of positioning indicia being positioned on said front side, each of said positioning indicia having an edge aligned with one of said positioning plates, each of said indicia consisting of said positioning indicia being spaced 16 inches from each other;

a handle being attached to said top side of said bar, said handle being generally centrally positioned with respect to said first and second ends; and wherein each of the studs is capable of being positioned against one of the positioning plates and aligned with one of said positioning indicia such that the studs are positioned 16 inches from each other.

* * * * *